US009688077B1

(12) United States Patent
Kaneko et al.

(10) Patent No.: US 9,688,077 B1
(45) Date of Patent: Jun. 27, 2017

(54) INK JET RECORDING APPARATUS

(71) Applicant: TOSHIBA TEC KABUSHIKI KAISHA, Shingawa-ku, Tokyo (JP)

(72) Inventors: Yoshiaki Kaneko, Shizuoka (JP); Hiroyuki Ishikawa, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/178,741

(22) Filed: Jun. 10, 2016

(51) Int. Cl.
*B41J 2/18* (2006.01)
*B41J 2/045* (2006.01)

(52) U.S. Cl.
CPC ..... *B41J 2/18* (2013.01); *B41J 2/04588* (2013.01); *B41J 2/04586* (2013.01); *B41J 2202/12* (2013.01)

(58) Field of Classification Search
CPC ..... B41J 2/18; B41J 2/04588; B41J 2202/12; B41J 2/04586
See application file for complete search history.

(56) References Cited

U.S. PATENT DOCUMENTS

2008/0259145 A1* 10/2008 Nomura ..... B41J 2/17503 347/89
2011/0050793 A1* 3/2011 Kumagai ..... B41J 2/125 347/22

FOREIGN PATENT DOCUMENTS

JP 2001-323879 11/2001
JP 2015-107569 6/2015

* cited by examiner

*Primary Examiner* — Manish S Shah
*Assistant Examiner* — Yaovi M Ameh
(74) *Attorney, Agent, or Firm* — Amin, Turocy & Watson LLP; Gregory Turocy

(57) ABSTRACT

An inkjet recording apparatus according to an embodiment includes an ink jet head, a diaphragm-type first pump, a diaphragm-type second pump and a control device. The inkjet head ejects ink to an image receiving medium. The first pump supplies ink introduced from an ink storage section to the ink jet head. The second pump sucks ink that is not discharged from the ink jet head and discharges the sucked ink to a discharge chamber adjacent to a discharge section of the first pump at the upstream part of an ink supply path connected with the ink jet head. The control device drives the first pump and the second pump with same-phase driving voltage waveforms to make discharge timing of the first pump matching with that of the second pump.

1 Claim, 8 Drawing Sheets

INK JET RECORDING APPARATUS

FIELD

Embodiments described herein relate generally to an ink jet recording apparatus.

BACKGROUND

An ink jet recording apparatus comprises an inkjet head that ejects ink to an image receiving medium such as a paper and an ink supply device that supplies ink to the ink jet head. An apparatus that includes an ink circulation mechanism in the ink supply device is known as the ink jet recording apparatus.

The ink supply device of the inkjet recording apparatus includes a diaphragm-type first pump that supplies ink introduced from an external ink storage section to the ink jet head. The ink supply device includes a discharge chamber adjacent to a discharge section of the first pump. The ink is supplied from the discharge section of the first pump to the ink jet head via the discharge chamber. The ink jet head is provided with an introduction passage that introduces the ink supplied from the first pump to a nozzle section and a circulation passage that returns ink which is not ejected by the nozzle section to the ink supply device. The ink supply device further includes a second pump that returns the ink returned from the recirculation passage to the discharge chamber.

However, the conventional ink jet recording apparatus described above communicates with the discharge chamber common to the first pump and the second pump for interactively sucking and discharging ink according to operations of a diaphragm. Thus, there is a case in which the first pump and the second pump weaken mutually discharge pressures due to shift of discharge timing of the first pump and discharge timing of the second pump. In this case, pump functions of the first pump and the second pump cannot be used efficiently.

DETAILED DESCRIPTION

Figure 1:
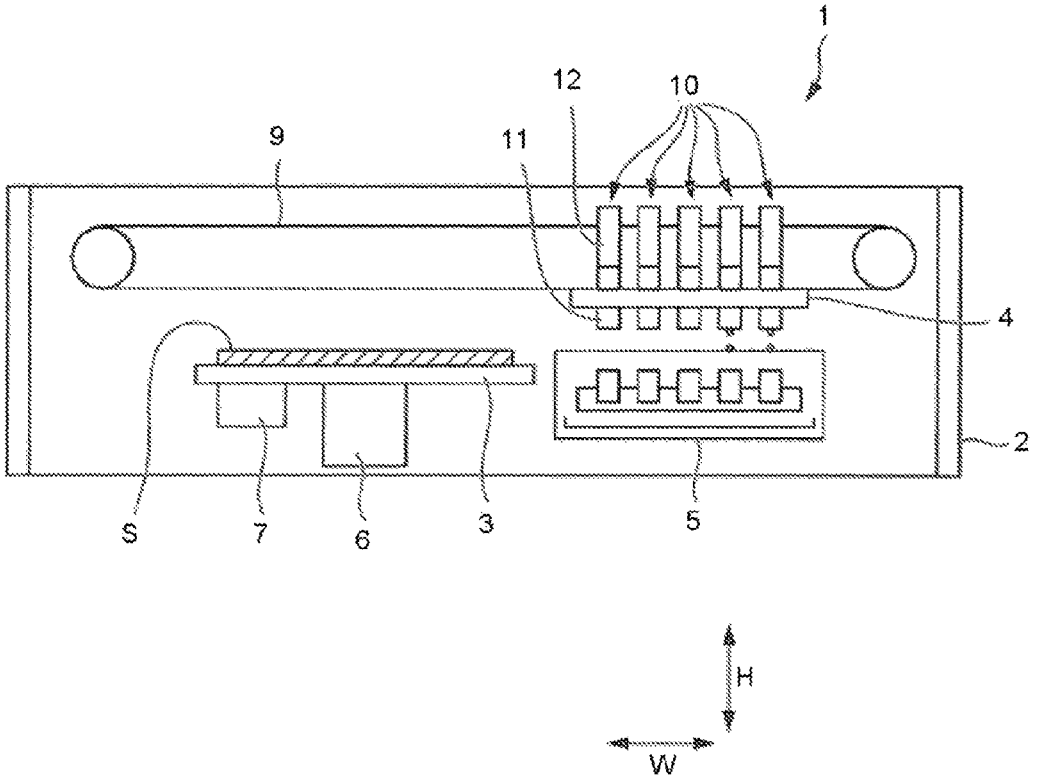
FIG. 1 is a front view schematically illustrating an ink jet recording apparatus according to an embodiment.

An ink jet recording apparatus according to an embodiment comprise an ink jet head, a diaphragm-type first pump, a diaphragm-type second pump and a control device. The inkjet head ejects ink to an image receiving medium. The first pump supplies ink introduced from an ink storage section to the inkjet head. The second pump sucks ink that is not discharged from the ink jet head and discharges the sucked ink to a discharge chamber adjacent to a discharge section of the first pump at the upstream part of an ink supply path connected with the ink jet head. The control device drives the first pump and the second pump with same-phase driving voltage waveforms to make discharge timing of the first pump matching with that of the second pump.

Hereinafter, the embodiment is described with reference to the accompanying drawings. Further, the same components in each figure are applied with the same reference numerals.

Figure 2:
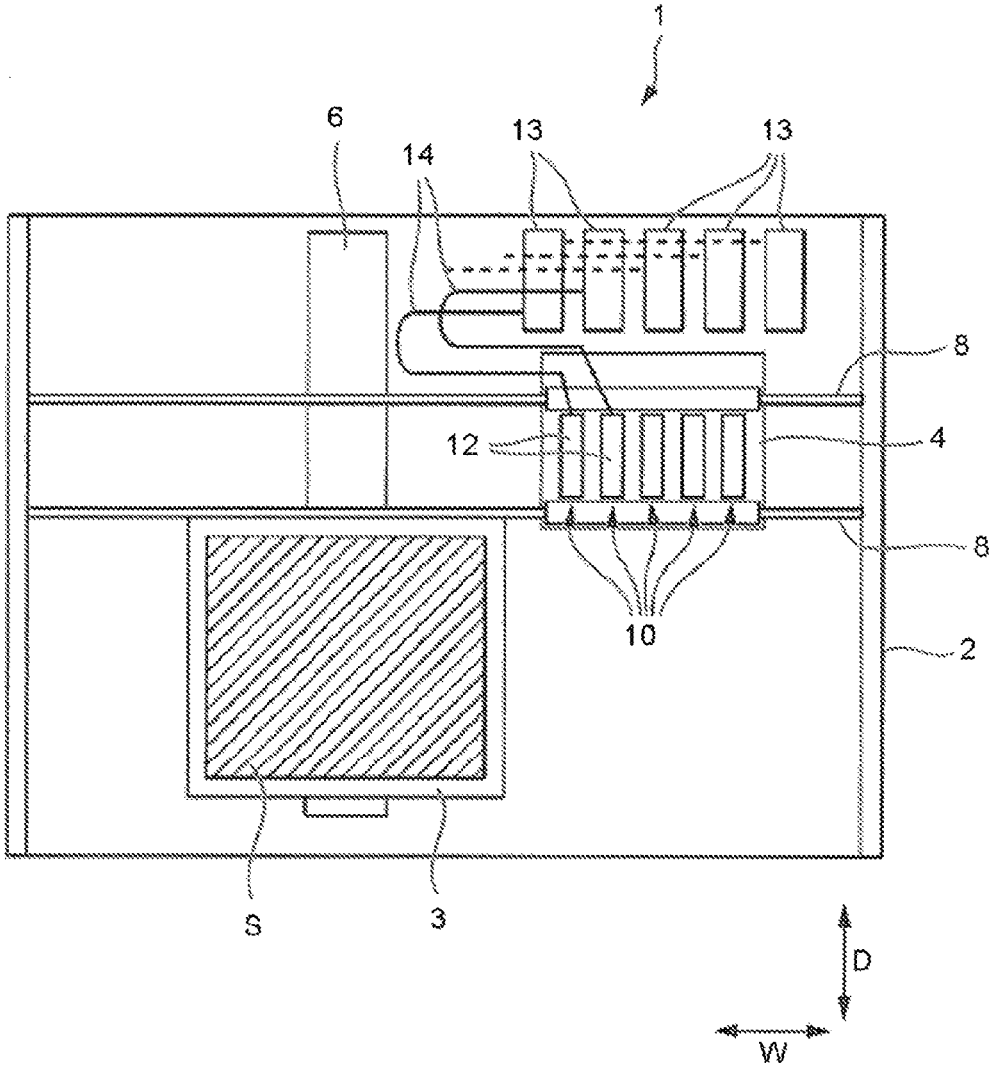
FIG. 2 is a plane view schematically illustrating the ink jet recording apparatus according to the embodiment.

FIG. 1 is a front view of an ink jet recording apparatus 1 of which a casing 2 is partially broken according to the embodiment. FIG. 2 is a plane view of the ink jet recording apparatus 1 of which the casing 2 is partially broken according to the embodiment.

A feed table 3, a carriage 4 and a maintenance unit 5 are arranged inside the casing 2 of the ink jet recording apparatus 1. The feed table 3 is held slidably on a guide rail for feeding 6 arranged inside the casing 2. The guide rail for feeding 6 extends linearly in a substantially horizontal direction. The feed table 3 is operated movably in a direction along the guide rail for feeding 6 through a motor (not-shown). Further, a negative pressure generation device 7 for adsorbing and fixing a sheet-like image receiving medium S such as a sheet on the feed table 3 is mounted on the lower part of the feed table 3. Further, the image receiving medium S is not limited to a sheet and may be a resin film or metal film, a wooden plate and the like.

The carriage 4 is held slidably on a guide rail for scanning 8 arranged inside the casing 2. The guide rail for scanning 8 extends linearly in a substantially horizontal direction orthogonal to the guide rail for feeding 6. The carriage 4 is operated movably in a direction along the guide rail for scanning 8 through a conveyance belt 9 driven by a motor (not shown).

A plurality of inkjet units 10 arranged along a scanning direction of the carriage 4 is mounted on the carriage 4. Each inkjet unit 10 comprises an ink jet head 11 that ejects ink to the image receiving medium and an ink supply device 12 at the upper part side of the ink jet head 11 that is combined with the ink jet head 11. The inkjet units 10 with a specific number corresponding to the number of types of ink to be ejected to the image receiving medium S are mounted on the carriage 4. The ink ejected from each inkjet unit 10 may be, in addition to ink in a color different from colors such as cyan, magenta, yellow, black and white, ink having transparent gloss, special ink that generates a color when irradiated by infrared rays or ultraviolet rays and the like.

Ink cartridges 13 (ink storage sections) arranged inside the casing 2 are correspondingly connected with the ink supply devices 12 of the inkjet units 10. The ink supply devices 12 of the inkjet units 10 and the ink cartridges 13 are correspondingly connected by flexible connection tubes 14.

A plurality of the inkjet units 10 is intensively arranged on the carriage 4 and moves along the guide rail for scanning 8 together with the carriage 4. The carriage 4 moves within a range intersecting with a move track of the feed table 3 when the ink is ejected from the ink jet head 11 to the image receiving medium S on the feed table 3. The carriage 4 stops at a standby position away from the move track of the feed table 3 as shown in FIG. 1 and FIG. 2 when the ink is not ejected from the ink jet head 11.

The maintenance unit 5 covers the ink ejecting part of each inkjet head 11 to prevent the ink from evaporating when a plurality of the inkjet units 10 returns to the standby position together with the carriage 4. Further, the maintenance unit 5 properly cleans the contact part of the ink jet head 11 with the image receiving medium S when a plurality of the inkjet units 10 returns to the standby position.

The ink jet head 11 of each inkjet unit 10 is provided with a plurality of nozzle sections (not shown) that ejects ink to the image receiving medium S and an actuator (not shown) arranged to face the nozzle section. The actuator is composed of a piezoelectric vibration plate and the like using a piezoelectric ceramic. The structure of the actuator is not limited to this and may be optional as long as pressure of ink can be increased in response to an input signal.

The ink jet recording apparatus 1 according to the embodiment, in a case of carrying out printing on the image receiving medium S according to the input signal, enables the carriage 4 on which the inkjet unit 10 is mounted and the feed table 3 on which the image receiving medium S is placed to properly move linearly, and at the same time, ejects ink from a specific nozzle section corresponding to the input signal of the ink jet head 11.

Further, in the embodiment, the image receiving medium S is fixedly adsorbed on the feed table 3, the inkjet unit 10 moves in a direction orthogonal to the moving direction of the feed table 3 while the feed table 3 moves in one direction, and the printing is carried out on the image receiving medium S according to the input signal. However, the image receiving medium S and the feeding method of the image receiving medium S are not limited to these. For example, a roll-type image receiving medium like a rolled paper may be used, the image receiving medium may be pulled out from a roller, and at the same time, the printing may be carried out on the image receiving medium with the inkjet head. Alternatively, sheet-like image receiving media may be fed one by one through a platen roller, and at the same time, the printing may be carried out on the image receiving medium with the ink jet head.

Figure 3:
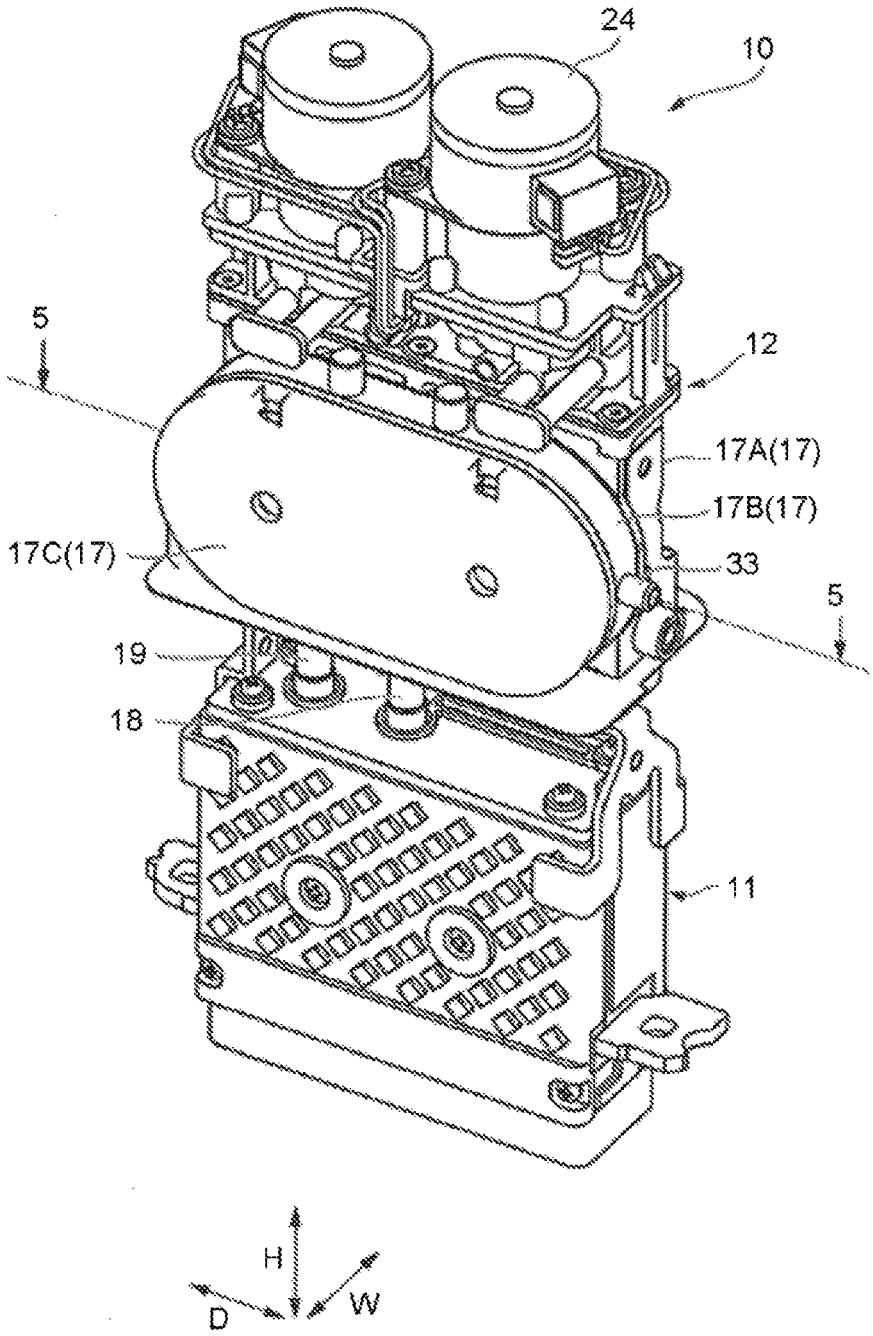
FIG. 3 is a perspective view of an inkjet unit according to the embodiment.
Figure 4:
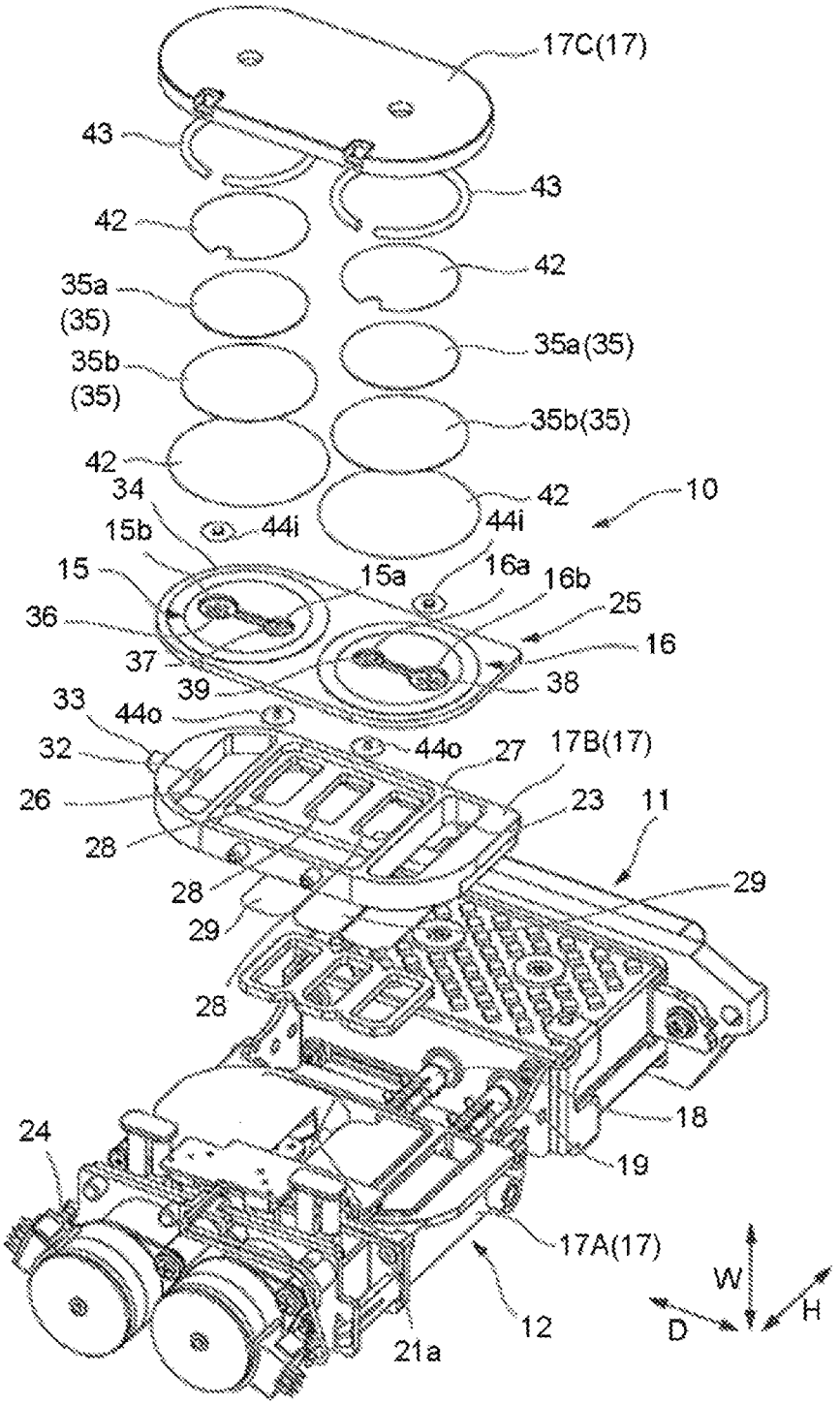
FIG. 4 is an exploded perspective view of the inkjet unit according to the embodiment.
Figure 5:
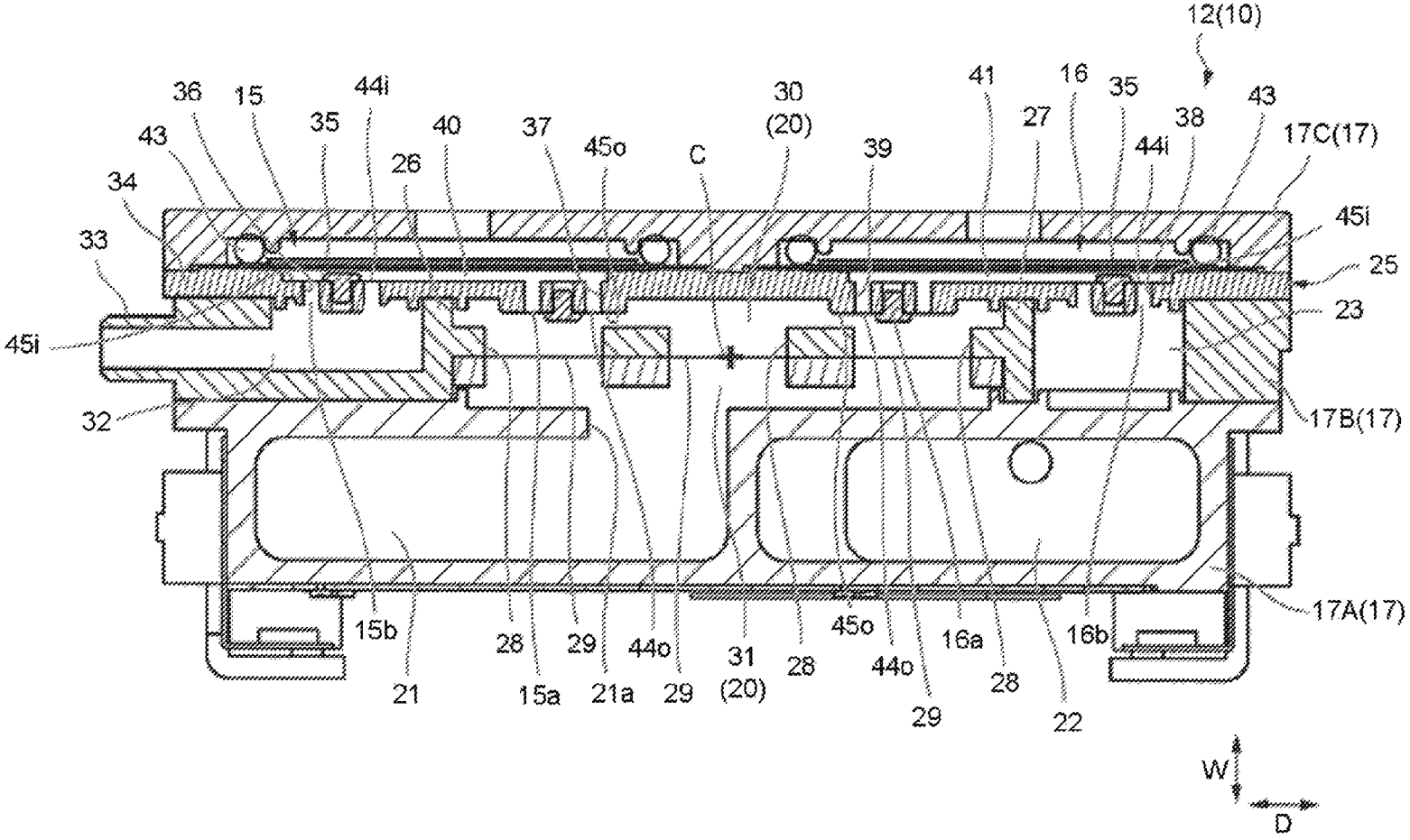
FIG. 5 is a cross-sectional diagram of the inkjet unit taken along 5-5 line shown in FIG. 3 according to the embodiment.

FIG. 3 is a perspective view of the inkjet unit 10. FIG. 4 is an exploded perspective view of the inkjet unit 10. FIG. 5 is a cross-sectional diagram of the inkjet unit 10 taken along 5-5 line shown in FIG. 3.

In the inkjet unit 10, as stated above, the ink supply device 12 is combined with the upper part of the inkjet head 11 integrally. The ink supply device 12 according to the embodiment includes a supply path that supplies the ink introduced from the external ink cartridge 13 (ink storage section) to the inkjet head 11 and a return path that returns the ink that is not ejected from the nozzle section of the ink jet head 11. The ink supply device 12 includes, as shown in FIG. 4 and FIG. 5, a casing 17 in which a first pump 15 and a second pump 16 are built. The casing 17, as shown in FIG. 3 and FIG. 4, includes an ink supply tube 18 for supplying the ink to the nozzle section of the ink jet head 11 and an ink return tube 19 for returning the ink that is not ejected by the nozzle section of the inkjet head 11 from the ink jet head 11.

The first pump 15 is a supply pump for replenishing a great amount of ink consumed by the printing and a maintenance operation from the ink cartridge 13 and supplying the ink to the ink jet head 11. In the casing 17, as shown in FIG. 5, a discharge chamber 20 is formed. The discharge chamber 20 is arranged at the upstream part of the supply path of the ink towards the ink jet head 11 to face a discharge section 15*a* of the first pump 15.

In the inner part of the casing 17, a supply side ink chamber 21 and a collection side ink chamber 22 that can temporarily store the ink are formed. The supply side ink chamber 21 is arranged to be adjacent to the downstream part of the discharge chamber 20 inside the casing 17. The supply side ink chamber 21 is connected with the ink supply tube 18. The ink stored in the supply side ink chamber 21 is supplied to the ink jet head 11.

The collection side ink chamber 22 is connected with the ink return tube 19. The ink that is not ejected by ink jet head 11 flows into the collection side ink chamber 22 through the ink return tube 19. The collection side ink chamber 22 is arranged in the return path inside the casing 17. A suction chamber 23 is arranged to be adjacent to the downstream side of the return path. The sucking section 16*b* of the second pump 16 is arranged to face the suction chamber 23.

The second pump 16 is a circulation pump for returning the ink flowing into the suction chamber 23 from the collection side ink chamber 22 to the discharge chamber 20. A discharge section 16*a* of the second pump 16 is arranged to face the discharge chamber 20. The discharge sections 15*a* and 16*a* of the first pump 15 and the second pump 16 are arranged in parallel to face the discharge chamber 20. The ink supply device 12 according to the embodiment takes the second pump 16 as a driving source to enable the ink to circulate between the ink jet head 11 and the ink supply device 12.

Further, upper parts of ink liquid surfaces in the supply side ink chamber 21 and the collection side ink chamber 22 are regarded as air chambers. Pressure in each air chamber is detected by a pressure sensor (not shown). A pressure adjustment section 24 is arranged at the upper part of the casing 17 as shown in FIG. 3 and FIG. 4. The pressure adjustment section 24 adjusts the pressure of the ink supplied to the ink jet head 11 to suitable pressure according to a detection result of a pressure sensor.

The casing 17 of the ink supply device 12 is wholly formed into a substantially rectangular shape. When the inkjet unit 10 is mounted on the carriage 4 (refer to FIG. 1 and FIG. 2), the size of the casing 17 in a width direction W matching with the scanning direction of the carriage 4 is shorter than that in a depth direction D matching with a feeding direction of the feed table 3 and that in a height direction H. The casing 17, as shown in FIG. 4 and FIG. 5, includes a casing main body 17A in which the supply side ink chamber 21 and the collection side ink chamber 22 are formed, and a pump unit case 17B combined with one side portion of the casing main body 17A in the width direction W. The casing 17 further includes a unit cover 17C combined with the pump unit case 17B in a state in which a pump unit 25 is inserted between the pump unit case 17B and the unit cover 17C.

The supply side ink chamber 21 and the collection side ink chamber 22 are arranged in parallel in the casing main body 17A in the depth direction D, and lower ends thereof each are connected with the ink supply tube 18 and the ink return tube 19. In the state in which the inkjet unit 10 is mounted on the carriage 4, the ink flows from the supply side ink chamber 21 to the ink supply tube 18 vertically downward.

The front view of the pump unit case 17B is formed into a long substantially elliptical shape in the depth direction D. The inner of the peripheral wall of the pump unit case 17B is partitioned into three areas by a first partition wall 26 and a second partition wall 27 that extend in the height direction H. Three communication ports 28 are formed at the center area sandwiched between the first partition wall 26 and the second partition wall 27 of the pump unit case 17B. The three communication ports 28 are formed within a range biased towards the lower side of the pump unit case 17B in the height direction H.

The front surface and rear surface of the pump unit case 17B in the width direction W are overlapped with the side surface of the pump unit 25 and the side surface of the casing main body 17A respectively. The foregoing discharge chamber 20 is formed by the center area of the pump unit case 17B and the side surfaces of the pump unit 25 and the casing main body 17A. Each of the discharge sections 15*a* and 16*a* of the first pump 15 and the second pump 16 on the pump unit 25 faces the discharge chamber 20. Further, a filter 29 is mounted on the three communication ports 28 of the pump unit case 17B. The filter 29 partitions the inner of the discharge chamber 20 into an upstream chamber 30 and a downstream chamber 31, and traps air bubbles mixed into the ink that passes through the communication port 28 at the upstream chamber 30 side. The downstream chamber 31 communicates with the supply side ink chamber 21 in the casing main body 17A via an opening 21*a*.

The area of one side of the pump unit case 17B partitioned by the first partition wall 26 constitutes the suction chamber 32 that faces a sucking section 15*b* of the first pump 15 on the pump unit 25. An ink introducing section 33 communicating with the suction chamber 32 is formed in the pump unit case 17B. The other end of the connection tube 14 (refer to FIG. 1 and FIG. 2) of which one end is connected with the corresponding ink cartridge 13 is connected with the ink introducing section 33. The ink is introduced from the ink cartridge 13 into the suction chamber 32 through the ink introducing section 33.

The area of the other side partitioned by the second partition wall 27 of the pump unit case 17B constitutes the suction chamber 23 that faces the sucking section 16*b* of the second pump 16 on the pump unit 25. The suction chamber 23 communicates with the collection side ink chamber 22 at the casing main body 17A side.

In the embodiment, the first pump 15 and the second pump 16 constitute an ink supply pump that supplies the ink to the ink jet head 11. Either of the first pump 15 and the second pump 16 is composed of the diaphragm-type pump. The first pump 15 and the second pump 16 are arranged to be adjacent to each other on an integral block as a pump unit 25.

The pump unit 25, as shown in FIG. 4, includes a base plate 34 fixedly sandwiched between the pump unit case 17B and the unit cover 17C, and a pair of piezoelectric vibrating membranes 35 mounted on the surface of the base plate 34 at the unit cover 17C side. A sucking hole 36 and a discharge hole 37 of the first pump 15 that penetrate the base plate 34 in the width direction W are formed at one side of the base plate 34 in the depth direction D. A sucking hole 38 and a discharge hole 39 of the second pump 16 that penetrate the base plate 34 in the width direction W are formed at the other side of the base plate 34 in the depth direction D. One piezoelectric vibrating membrane 35 is mounted in a range across the sucking hole 36 and the discharge hole 37 on the base plate 34 to cover the surrounding of the range. Similarly, the other piezoelectric vibrating membrane 35 is mounted in a range across the sucking hole 38 and the discharge hole 39 on the base plate 34 to cover the surrounding of the range.

A pump chamber 40 of the first pump 15 is formed between one piezoelectric vibrating membrane 35 and the base plate 34, as shown in FIG. 5. Further, a pump chamber 41 of the second pump 16 is formed between the other piezoelectric vibrating membrane 35 and the base plate 34, as shown in FIG. 5. The piezoelectric vibrating membrane 35 is formed mainly by bonding a piezoelectric element 35*a* to a metal plate 35*b*, as shown in FIG. 4. Further, a sign 42 shown in FIG. 4 is a protecting sheet that covers two sides of the piezoelectric vibrating membrane 35. Further, a sign 43 shown in FIG. 4 is a retaining ring for retaining the piezoelectric vibrating membrane 35 and the peripheral portion of the protecting sheet 42 to fix them on the base plate 34.

In the sucking section 15*b* of the first pump 15, a sheet-like valve body 44*i* for opening and closing the sucking hole 36 is mounted in the forming part of the sucking hole 36 that communicates the suction chamber 32 with the pump chamber 40. The valve body 44*i*, arranged at the inner side of the pump chamber 40, is abutted against or separated from a valve seat 45*i* along the peripheral edge of the sucking hole 36 from the inner side of the pump chamber 40. In the discharge section 15*a* of the first pump 15, sheet-like valve body 44*o* for opening and closing the discharge hole 37 is arranged in the forming part of the discharge hole 37 that communicates the pump chamber 40 with the discharge chamber 20 (the upstream chamber 30). The valve body 44*o*, arranged at the discharge chamber 20 side (at the outer side of the pump chamber 40), is abutted against or separated from a valve seat 45*o* along the peripheral edge of the discharge hole 37 from the discharge chamber 20 side.

In the sucking section 16*b* of the second pump 16, a sheet-like valve body 44*i* for opening and closing the sucking hole 38 is mounted in the forming part of the sucking hole 38 that communicates the suction chamber 23 with the pump chamber 41. The valve body 44*i*, arranged at the inner side of the pump chamber 41, is abutted against or separated from the valve seat 45*i* along the peripheral edge of the sucking hole 38 from the inner side of the pump chamber 41. In the discharge section 16*a* of the second pump 16, a sheet-like valve body 44*o* for opening and closing the discharge hole 39 is mounted in the forming part of the discharge hole 39 that communicates the pump chamber 41 with the discharge chamber 20 (the upstream chamber 30). The valve body 44*o*, arranged at the discharge chamber 20 side (at the outer side of the pump chamber 41), is abutted against or separated from the valve seat 45*o* along the peripheral edge of the discharge hole 39 from the discharge chamber 20 side.

Figure 6:
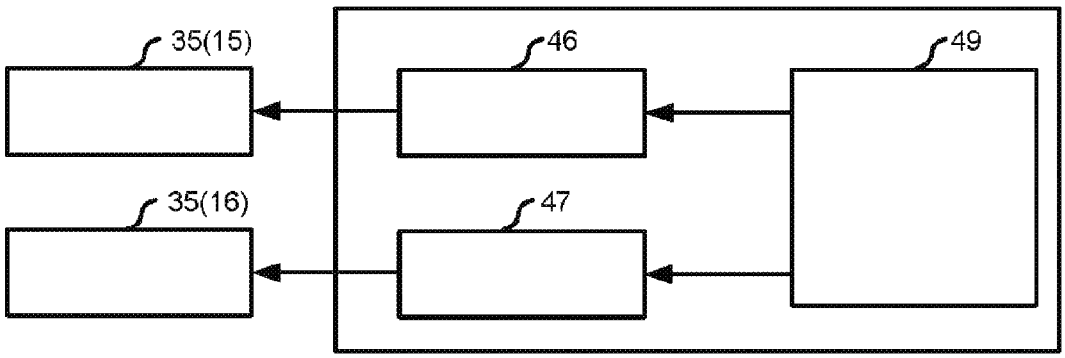
FIG. 6 is a block diagram illustrating the structure of a pump driving system of the ink jet recording apparatus according to the embodiment.

FIG. 6 is a block diagram illustrating the structure of a driving system of the first pump 15 and the second pump 16.

As shown in FIG. 6, the piezoelectric vibrating membranes 35 of the first pump 15 and the second pump 16 separately receive driving voltages from corresponding driving circuits 46, 47 to be driven. Each of the driving circuits 46 and 47 outputs a driving voltage corresponding to a control signal of a control device 49 to the corresponding piezoelectric vibrating membrane 35. The piezoelectric vibrating membranes 35 are separately applied with pulse driving voltages from the driving circuits 46 and 47 cyclically, and thus the center areas thereof change according to the change of the driving voltages. In this way, the volumes of the pump chambers 40 and 41 of the first pump 15 and the second pump 16 are increased or decreased, valve bodies 44*i* and 44*o* at the sucking side and discharge side are interactively opened and closed.

Figure 7A:
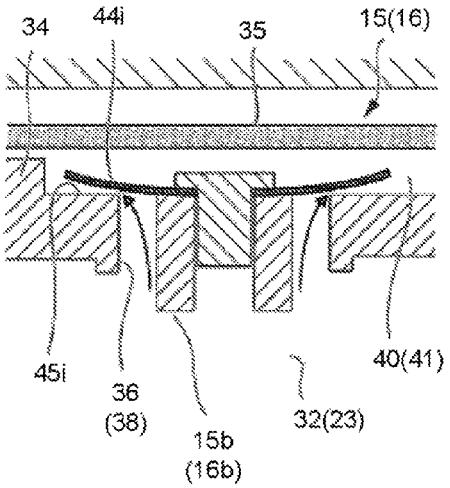
FIG. 7A is a cross-sectional diagram illustrating a sucking section of a pump according to the embodiment.
Figure 7B:
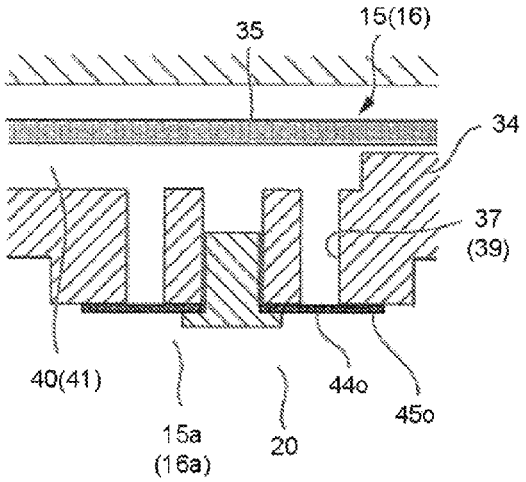
FIG. 7B is a cross-sectional diagram illustrating a discharge section of the pump according to the embodiment.
Figure 8A:
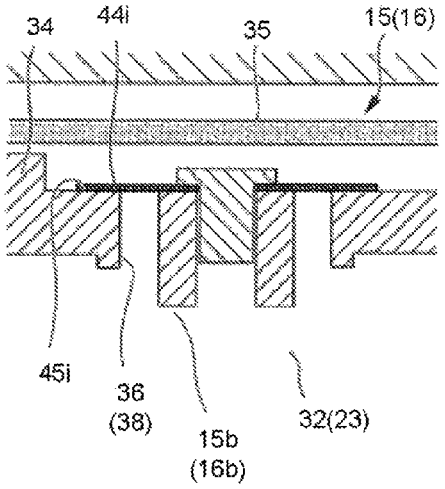
FIG. 8A is a cross-sectional diagram illustrating the sucking section of the pump according to the embodiment.
Figure 8B:
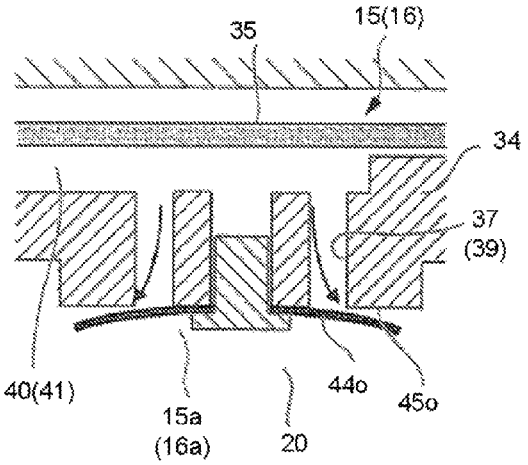
FIG. 8B is a cross-sectional diagram illustrating the discharge section of the pump according to the embodiment.

FIG. 7A is a cross-sectional diagram illustrating behaviors of the valve bodies 44*i* of the sucking sections 15*b* and 16*b* when the volumes of the pump chambers 40 and 41 of the first pump 15 and the second pump 16 are increased. FIG. 7B is a cross-sectional diagram illustrating behaviors of the valve bodies 44*o* of the discharge sections 15*a* and 16*a* when the volumes of the pump chambers 40 and 41 of the first pump 15 and the second pump 16 are increased. Further, FIG. 8A is a cross-sectional diagram illustrating behaviors of the valve bodies 44*i* of the sucking sections 15*b* and 16*b* when the volumes of the pump chambers 40 and 41 of the first pump 15 and the second pump 16 are decreased. FIG. 8B is a cross-sectional diagram illustrating behaviors of the valve bodies 44*o* of the discharge sections 15*a* and 16*a* when the volumes of the pump chambers 40 and 41 of the first pump 15 and the second pump 16 are decreased.

In the first pump 15 and the second pump 16, as shown in FIG. 7A and FIG. 7B, if the piezoelectric vibrating membranes 35 receive the driving voltages to make the volumes of the pump chambers 40 and 41 increased, the valve bodies 44*i* of the sucking sections 15*b* and 16*b* open the sucking holes 36 and 38, and the valve bodies 44*o* of the discharge sections 15*a* and 16*a* close the discharge holes 37 and 39. In this way, the ink is sucked from the sucking chambers 32 and 23 into the pump chambers 40 and 41. Further, in the first pump 15 and the second pump 16, as shown in FIG. 8A and FIG. 8B, if the piezoelectric vibrating membranes 35 make the volumes of the pump chambers 40 and 41 decreased, the valve bodies 44*i* of the sucking sections 15*b* and 16*b* close the sucking holes 36 and 38, the valve bodies 44*o* of the discharge sections 15*a* and 16*a* open the discharge holes 37 and 39. In this way, the ink in the pump chambers 40 and 41 is discharged to the discharge chamber 20 (the upstream chamber 30) through the discharge holes 37 and 39. By repeating the operations described above in the first pump 15 and the second pump 16, the ink in the suction chambers 32 and 23 is supplied to the discharge chambers 20 continuously.

In the ink supply device 12 according to the embodiment, if the ink from the first pump 15 and the second pump 16 is discharged to the upstream chamber 30 of the discharge chamber 20, the ink passes through the filter 29 and then flows into the downstream chamber 31. At this time, the filter 29 traps bubbles mixed into the ink and suppresses the flow of the bubbles into the downstream chamber 31. In this way, after the ink flowing into the downstream chamber 31 in which the bubbles are removed is temporarily stored in the supply side ink chamber 21, the ink is supplied to the nozzle section of the ink jet head 11 through the ink supply tube 18. Further, the ink that is not ejected by the nozzle section of the ink jet head 11 flows into the collection side ink chamber 22 of the ink supply device 12 through the ink return tube 19. The ink flowing into the collection side ink chamber 22 flows into the suction chamber 23. The ink flowing into the suction chamber 23 is discharged to the upstream chamber 30 through the second pump 16 again.

As shown in FIG. 5, in the discharge chamber 20, an ink flowing path from the discharge section 15*a* of the first pump 15 to a center part C of the discharge chamber 20 and an ink flowing path from the discharge section 16*a* of the second pump 16 to the center part C of the discharge chamber 20 are together formed into a symmetrical shape. That is, the two ink flowing paths are located at symmetrical positions where the center part C of the discharge chamber 20 is sandwiched therebetween, and it is set that the length of the flowing path and the shape of the cross-section are substantially identical to each other.

In a case in which the first pump 15 and the second pump 16 operate together, the control device 49 controls the operation of each piezoelectric vibrating membrane 35 to always match the discharge timing of the first pump 15 with that of the second pump 16. That is, the control device 49 controls each of the driving circuits 46 and 47 of the first pump 15 and the second pump 16 to output a same-phase driving voltage waveform to the corresponding piezoelectric vibrating membranes 35.

Figure 9:
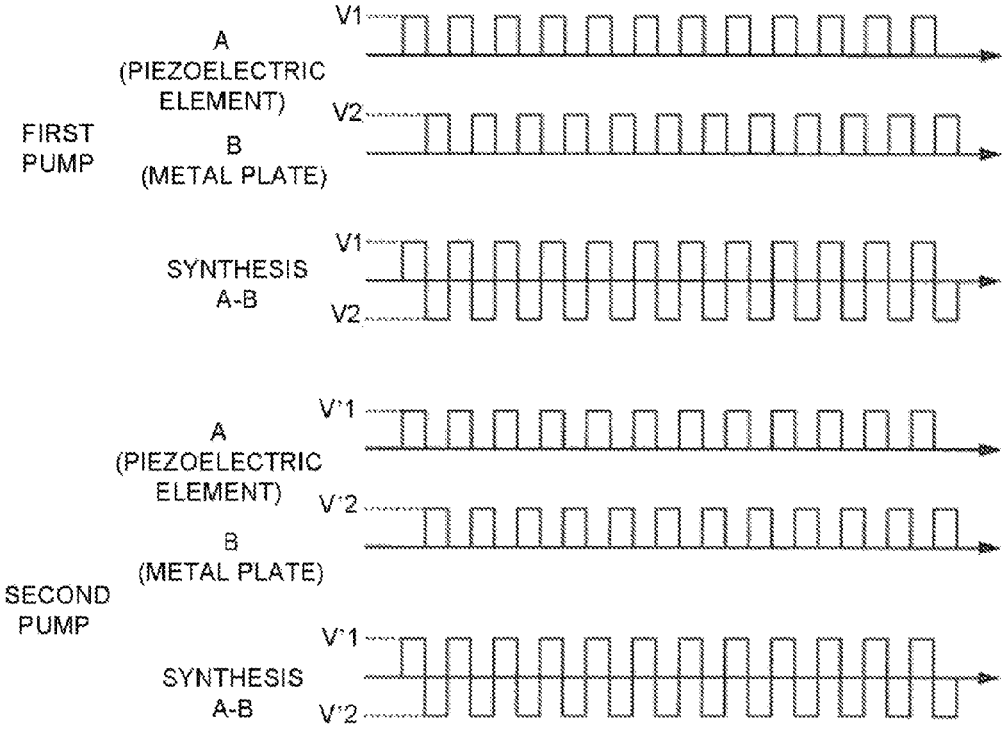
FIG. 9 is a diagram illustrating driving waveforms of a first pump and a second pump according to the embodiment.

FIG. 9 is a diagram illustrating a driving voltage waveform output from the driving circuit 46 of the first pump 15 and a driving voltage waveform output from the driving circuit 47 of the second pump 16. "V1" shown in FIG. 9 refers to a pulse voltage output from the driving circuit 46 of the first pump 15 to the piezoelectric element 35*a* of the piezoelectric vibrating membrane 35, and "V2" shown in FIG. 9 refers to a pulse voltage output from the driving circuit 46 of the first pump 15 to the metal plate 35*b* of the piezoelectric vibrating membrane 35. Further, "V'1" shown in FIG. 9 refers to a pulse voltage output from the driving circuit 47 of the second pump 16 to the piezoelectric element 35*a* of the piezoelectric vibrating membrane 35, and "V'2" shown in FIG. 9 refers to a pulse voltage output from the driving circuit 47 of the second pump 16 to the metal plate 35*b* of the piezoelectric vibrating membrane 35.

"A-B" of the upper stage in FIG. 9 illustrates a driving voltage waveform obtained by synthesizing the driving voltages output from the driving circuit 46 to the piezoelectric element 35*a* and the metal plate 35*b* of the piezoelectric vibrating membrane 35. Further, A-B of lower stage in FIG. 9 illustrates a driving voltage waveform obtained by synthesizing the driving voltages output from the driving circuit 47 to the piezoelectric element 35*a* and the metal plate 35*b* of the piezoelectric vibrating membrane 35. The control device 49 controls the driving circuits 46 and 47 to match the driving voltage waveform of the upper stage with the driving voltage waveform of the lower stage.

In the ink jet recording apparatus 1 according to the embodiment, the control device 49 drives the first pump 15 and the second pump 16 with the same-phase driving voltage waveform. Thus, the discharge timing of the first pump 15 is matching with the discharge timing of the second pump 16, and therefore the first pump and the second pump cannot mutually weaken discharge pressures.

Figure 10:
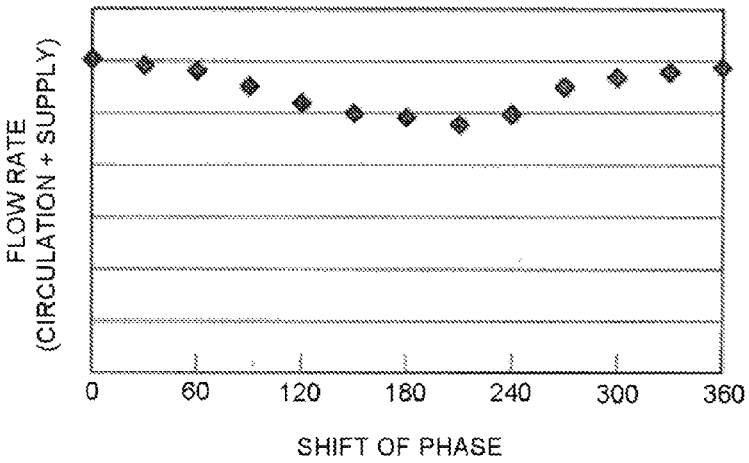
FIG. 10 is a diagram illustrating a relationship between shift of discharge phases of the first pump and the second pump and total discharge flow rate of ink.

FIG. 10 is a graph illustrating a relationship between shift of discharge phase of the first pump 15 and the second pump 16 and total discharge flow rate of ink when the first pump 15 and the second pump 16 operate together.

As shown in FIG. 10, the total discharge flow rate of the ink is almost minimal when the discharge phase of the first pump 15 is shifted from that of the second pump 16 by 180 degrees, and is almost maximum when the discharge phase of the first pump 15 is not shifted from that of the second pump 16. In the ink jet recording apparatus 1 according to the embodiment, as the discharge phase of the first pump 15 is not shifted from that of the second pump 16, the pump functions of the first pump 15 and the second pump 16 can be used more efficiently.

Further, in the ink jet recording apparatus 1 according to the embodiment, the ink flowing path from the discharge section 15*a* of the first pump 15 to the center part C of the discharge chamber 20 and the ink flowing path from the discharge section 16*a* of the second pump 16 to the center part C of the discharge chamber 20 are formed into the symmetrical shapes. Thus, the pressure of the ink discharged from the discharge section 15*a* of the first pump 15 and that discharged from the discharge section 16*a* of the second pump 16 are synthesized with the same phase nearby the center part C of the discharge chamber 20. Thus, in the ink jet recording apparatus 1, the pump functions of the first pump 15 and the second pump 16 can be used more efficiently.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink jet recording apparatus, comprising:

an ink jet head configured to eject ink to an image receiving medium;

a diaphragm-type first pump configured to supply ink introduced from an ink storage section to the ink jet head;

a diaphragm-type second pump configured to suck ink that is not discharged from the ink jet head and discharge the sucked ink to a discharge chamber adjacent to a discharge section of the first pump at the upstream part of an ink supply path connected with the ink jet head;

a control device configured to drive the first pump and the second pump with same-phase driving voltage waveforms to make discharge timing of the first pump matching with that of the second pump; and an ink flowing path from the discharge section of the first pump to a center part of the discharge chamber and an ink flowing path from the discharge section of the second pump to the center park of the discharge chamber are formed into symmetrical shapes.

* * * * *